United States Patent [19]

Irwin

[11] 4,187,691

[45] Feb. 12, 1980

[54] HEAT PUMP BYPASS VALVE ARRANGEMENT

[75] Inventor: John W. Irwin, Trenton, N.J.

[73] Assignee: General Electric Company, Louisville, Ky.

[21] Appl. No.: 933,332

[22] Filed: Aug. 14, 1978

[51] Int. Cl.[2] ..... F25B 13/00

[52] U.S. Cl. ..... 62/324

[58] Field of Search ..... 62/324 A, 324 R, 160, 62/504, 511, 81

[56] References Cited

U.S. PATENT DOCUMENTS

| | | | |
|---|---|---|---|
| 2,715,317 | 8/1955 | Rhodes | 62/324 A |
| 2,785,540 | 3/1957 | Biehn | 62/324 A |
| 3,029,614 | 4/1962 | Smith et al. | 62/324 A |
| 3,041,845 | 7/1962 | Trask | 62/324 A |
| 3,299,661 | 1/1967 | Harnish et al. | 62/324 A |
| 3,765,192 | 10/1973 | Root | 62/324 A |
| 4,012,920 | 3/1977 | Kirschbaum | 62/324 A |
| 4,055,056 | 10/1977 | Perkins | 62/324 A |

*Primary Examiner*—Lloyd L. King

*Attorney, Agent, or Firm*—Frank P. Giacalone; Radford M. Reams

[57] ABSTRACT

The present invention relates to a split system air conditioner and more particularly to the indoor section which is provided with a refrigerant flow valve bypass arrangement that permits multiple orientation of the indoor section.

3 Claims, 5 Drawing Figures

HEAT PUMP BYPASS VALVE ARRANGEMENT

Background of the Invention

Split system reverse flow heat pumps including indoor and outdoor sections are generally provided with indoor and outdoor flow control or expansion devices that are usually in a fixed relationship with the indoor and outdoor heat exchangers respectively. Associated with these flow control devices are means for bypassing refrigerant around the flow control devices when refrigerant flow is in a direction from its associated heat exchanger, and, for closing off the bypass flow and allowing flow through the flow control device when flow is toward its associated heat exchanger.

In many instances, these bypass means are gravity biased ball valve devices and, accordingly, the orientation of the valve is critical. Since the valve is in fixed relationship with its associated heat exchanger, it is necessary for the proper operation of the ball valve device that the entire section or unit of the system including the heat exchanger and its other associated parts be properly oriented. When bypass ball valves are arranged in a fixed relationship with a cabinet, orientation of the cabinet is critical since a normally closed ball valve that is held against its valve seat by gravity will fall to its open position, and a ball valve that is maintained in an open position by gravity will fall to its closed position if the section were inverted. While valves can be provided that are designed to work in various orientations, these are usually more complicated devices and generally more expensive than the single ball valve device.

Summary of the Invention

A split refrigeration system air conditioner of the heat pump type is provided that includes an outdoor section having an outdoor heat exchanger and an indoor section having an indoor heat exchanger, with the indoor and outdoor heat exchanger being connected in a closed refrigerant circuit. The circuit includes a compressor having a discharge line and a suction line and reversing valve means for reversibly connecting said discharge and suction line to the heat exchangers for effecting flow of refrigerant through the circuit in either direction whereby the heat pump may be operated on a cooling cycle with the outdoor coil functioning as a condenser and receiving high pressure refrigerant from the compressor or in a heating cycle with the indoor coil functioning as a condenser and receiving high pressure refrigerant from the compressor.

An outdoor refrigerant flow control means is arranged in a fixed relationship relative to the outdoor heat exchanger, and an outdoor conduit means is arranged for bypassing refrigerant around the outdoor flow control means when refrigerant flow is in a direction from the outdoor heat exchanger toward the outdoor flow control means. An indoor refrigerant flow control means is arranged in a fixed relationship relating to the indoor heat exchanger, and an indoor conduit means is arranged for bypassing refrigerant around the indoor flow control means when refrigerant flow is in a direction from the indoor heat exchanger toward the indoor flow control means. The indoor conduit means has a first and second portion having their axes arranged so that a horizontal plane passes through the intersecting point of the two respective axes; with the axis of each portion extending from the intersecting point at a predetermined angle from said horizontal plane.

Description of the Preferred Embodiment

Figures 1, 2:
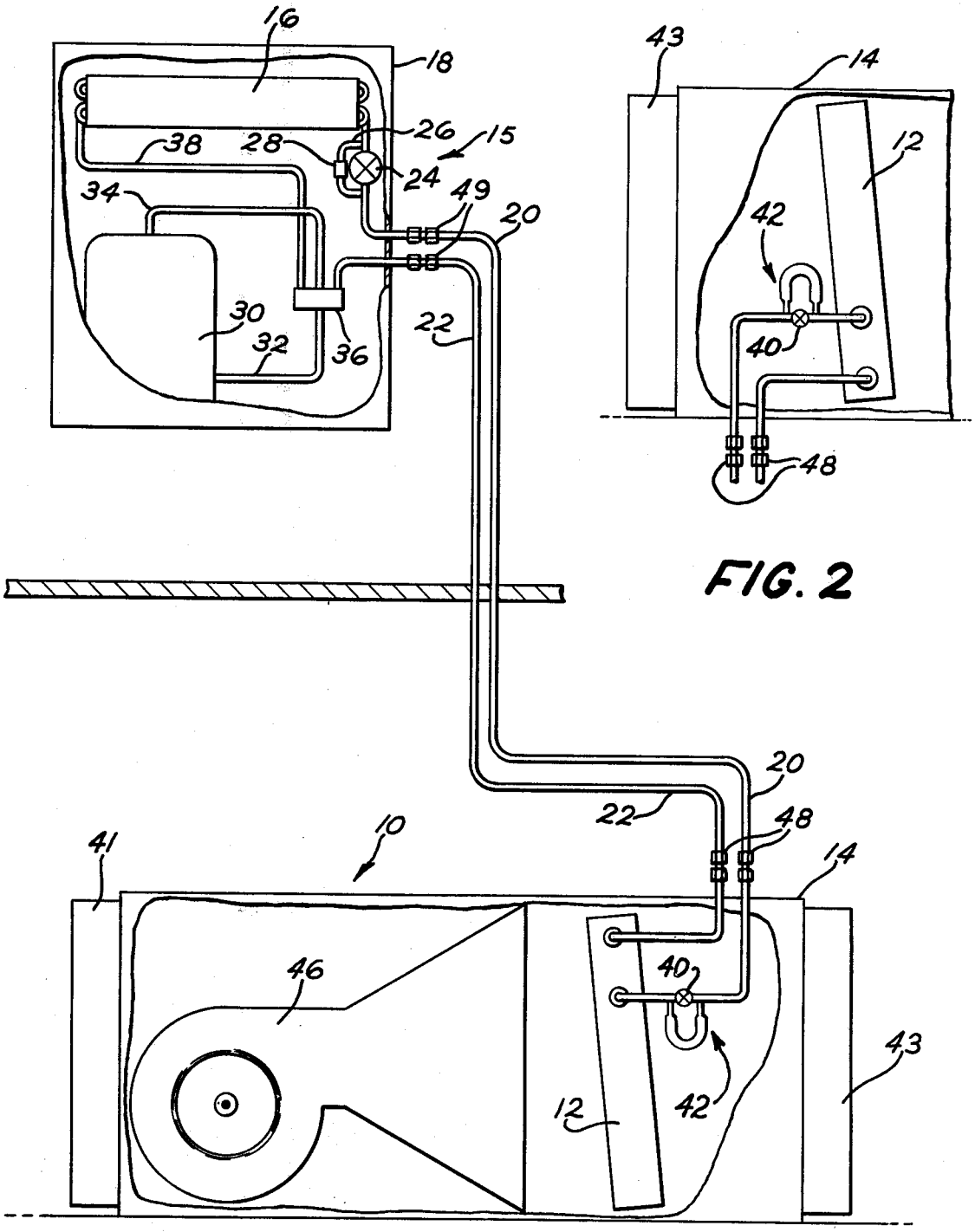
FIG. 1 is a schematic of a reversible split heat pump system.
FIG. 2 is a fragmentary portion of the indoor section shown on inverted position.

Referring now to the drawings and more particularly to FIG. 1 there is shown a split system heat pump which comprises an indoor section or unit 10 including the indoor heat exchanger 12 contained in a cabinet 14 and an outdoor section or unit 15 including an outdoor heat exchanger 16 contained in a cabinet 18. The indoor and outdoor sections are connected by suitable refrigerant tubing 20 and 22 connecting opposite sides of each of the heat exchangers and forming a closed refrigerant circuit.

The outdoor section comprises the outdoor heat exchanger 16, an outdoor capillary, or other flow control means such as a well known thermally controlled expansion valve 24, and means for bypassing refrigerant around the outdoor flow control 24 when the heat pump is operated as a cooling unit and the outdoor heat exchanger 16 is being utilized as a condenser.

In order to bypass refrigerant around the flow control device 24, there is provided a bypass line 26 and a check valve 28 which permits flow of refrigerant through the bypass line 26 when refrigerant is flowing from the heat exchanger 16 toward the flow control device 24, or when the heat exchanger is operating as a condenser. When the refrigerant is flowing from the indoor section 10 in the direction toward the heat exchanger 16, the check valve 28 closes and all the refrigerant must flow through the flow control device 24. The flow control 24 then changes the pressure of the refrigerant from condenser to evaporate pressure and the heat exchanger 16 is then operating as an evaporator.

The outdoor section 15 also includes a compressor 30 having a suction line 32 and a discharge line 34 connecting respectively with a reversing valve 36. The reversing valve 36 connects the suction line 32 and the discharge line 34 with the remaining portions of the circuit so that the compressor 30 withdraws refrigerant from either outdoor heat exchanger 16 or from indoor heat exchanger 12, and discharges refrigerant into the other of the two heat exchangers. More specifically, the reversing valve 36 connects the outdoor heat exchanger 16 by means of the conduit 38 and also connects with refrigerant tube 22 leading to the indoor heat exchanger 12.

The indoor section 10 comprises the indoor heat exchanger 12 and an indoor capillary or other flow control means such as a well known thermally controlled expansion valve 40 connected in series, and a bypass 42 means around the flow control device 40 for bypassing refrigerant around the flow control device 40 when the heat pump is operating on the heating cycle or, more specifically, when the refrigerant flow is from the heat exchanger 12 toward the flow control 42. In the illustrated embodiment the bypass means 42 includes the valve arrangement of the present invention and will be explained in detail hereinafter. The valve arrangement, however, like outdoor valve means 28, prevents the flow of refrigerant through the bypass 42 when refrigerant is flowing in the direction from the tube 20 leading from the outdoor section toward the heat exchanger 12. It should be mentioned that flow control means 40 is similar in operation to flow control means 24 and that both are sized to give optimum performance for the respective heating and cooling operations. That is, flow control means 40 provides the restriction for optimum performance of the refrigeration system under those conditions normally encountered during the cooling season and flow control means 24 provides the restriction to give optimum performance of the refrigeration system under those conditions normally encountered during the heating season.

When the system is operating in the cooling cycle, compressed refrigerant from the compressor 30 is directed by the reversing valve 36, through line 38, to the outdoor heat exchanger 16 in which the refrigerant is condensed. Liquid refrigerant flows from the outdoor heat exchanger 16 through the bypass line 26 and valve 28 and into conduit 20 which connects with the indoor section 10. Condensed refrigerant then flows through the indoor flow control device 40 into the indoor heat exchanger 12, which functions as an evaporator. In heat exchanger 12 the refrigerant is evaporated by absorbing the heat from an air stream circulated through the indoor section by an air mover 46 between an inlet 41 and an outlet 43.

When the system is operating in the heating cycle, the compressed refrigerant from the compressor 30 is directed by the reversing valve 36 through line 22 into heat exchanger 12 where the heat liberated during condensation heats the space being conditioned. The condensed refrigerant from the indoor heat exchanger 12 then flows through bypass line 42 and line 20 to the outdoor section. The refrigerant then passes through flow control device 24 and is expanded to evaporator pressures whereupon it enters heat exchanger 16 functioning as the evaporator.

In the type indoor section employed in the present embodiment, the lines 20 and 22 connecting the indoor and outdoor section into a sealed system are secured to the section 10 by appropriate connectors 48 arranged on a side wall of the cabinet 14 and connectors 49 conveniently arranged on the outdoor unit 15. During installation of the section 10, it may be inverted or more particularly oriented in either of the positions shown in FIG. 1 or 2. In employing gravity biased ball valves in the bypass line 42 which are inexpensive and at the same time reliable, the section 10 must be oriented in accordance with the valve position since their operation relies on proper orientation. A gravity ball valve oriented when section 10 is in the position shown in FIG. 1 to function as previously described in the heating and cooling cycle would be disabled when section 10 is in the position shown in FIG. 2.

By the present invention, a gravity biased valve system employing a reliable and relatively inexpensive ball valve system is employed in bypass line 42 that effectively provides the bypass flow relative to the flow control device 40 previously described in the operation of the system when the indoor section cabinet 14 is oriented in either of the positions shown in FIGS. 1 and 2.

Figure 3:
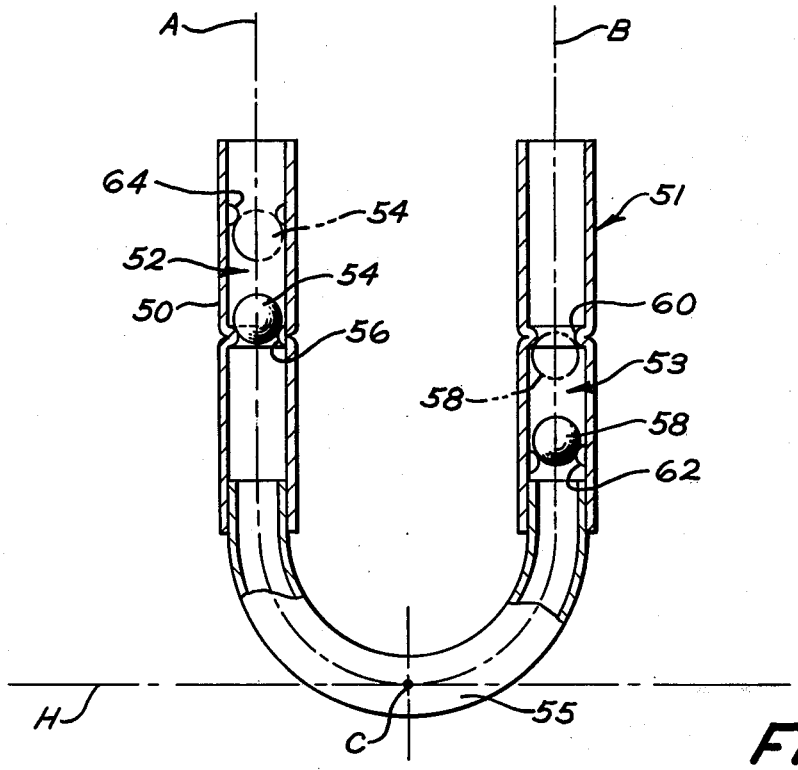
FIG. 3 is a sectional view of the indoor bypass line incorporating the valve system of the present invention.

Referring now to FIG. 3, there is shown in detail the bypass line 42 in which one embodiment of the valve arrangement of the present invention is incorporated.

The bypass line 42 which, as mentioned hereinbefore, is arranged at some point between the indoor heat exchanger 12 and the line connector 48 in a fixed relationship relative to the indoor cabinet 14.

The bypass line 42 in accordance with the present invention includes two tubular portions 50 and 51. Each of the tube portions 50, 51 includes a valve 52 and 53 respectively. The portions 50 and 51 are conveniently connected together in series flow relationship by a U-shaped tube portion 55 to complete the bypass line 42. Valve 52 comprises a ball valve member 54 which cooperated with a seat 56 arranged to project inwardly in the portion 50 of bypass line 42 and being dimensioned to engage ball 54 in sealing relationship therewith. With the tube portion 50 oriented, as shown in FIG. 3, the ball valve 54 is arranged so that it will be maintained by gravity on seat 56 to provide a normally closed valve positioned as shown. Valve 53 comprises a ball valve member 58 which cooperates with a seat 60 arranged to project inwardly in the portion 51 of bypass line 42 and being dimensioned to engage ball 58 in sealing relationship therewith. With the tube portion 51 oriented, as shown in FIG. 3, the ball valve 58 is arranged so that it will be maintained by gravity in a normally open position relative to the valve seat 60 and, as shown, will rest on spaced apart projections 62 which are positioned to allow flow past ball valve 58 when it is in its open position.

Figure 5:
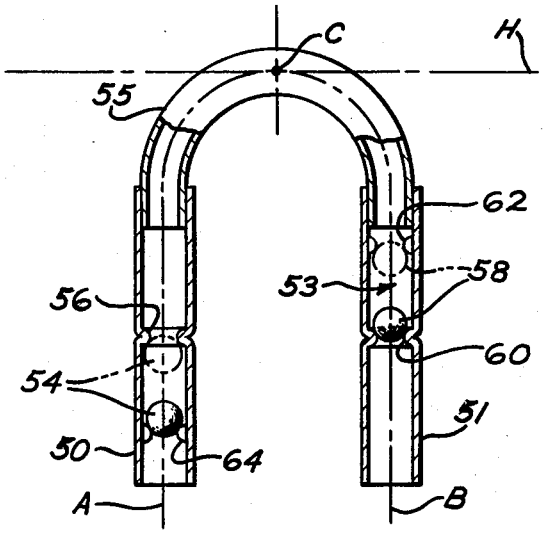
FIG. 5 is a view similar to FIG. 3 showing the bypass line in an inverted position.

In this arrangement, with the system operating in the heating cycle, as described above, refrigerant entering portion 51 will flow past ball valve 58 which is in its open position and into portion 52 to move ball valve 54 to its open position shown in broken lines and flow into the indoor heat exchanger 12. With the system operating in the cooling cycle, refrigerant will enter portion 52 and will be prevented from further flow by the ball valve 54 being in its closed position and refrigerant flow as described above will be through the flow control device 40. In the event the indoor section were inverted, as shown between the position shown in FIG. 21 and the position shown in FIG. 2, the bypass line 42 will be oriented as shown in FIG. 5. In this instance, refrigerant entering portion 51 in the heating cycle will lift valve 58 which will not be on its seat 60 and flow past ball valve 54 which will, in this position, be on spaced apart projection 62 as shown in broken lines. Accordingly, the designed flow of refrigerant toward the indoor heat exchanger 12 remains unchanged and refrigerant will always be through the bypass line 42 in the cooling cycle regardless of the orientation of outdoor section cabinet 14.

With reference to the heating cycle described above, refrigerant entering portion 52 of the bypass line 42 oriented as shown in FIG. 3 encounters the closed valve 52 and refrigerant flows through the flow control device 40. In the event the indoor section were inverted so the bypass line 42 is oriented in the position shown in FIG. 5, ball valve 54 will be on the projection 64 refrigerant entering portion 52 will engage ball valve 54 and move it into engagement with its valve seat 56. Any refrigerant flowing pass ball valve 54 will, in this instance, encounter the closed valve 58 and refrigerant flow will be through the flow control device 40.

Figure 4:
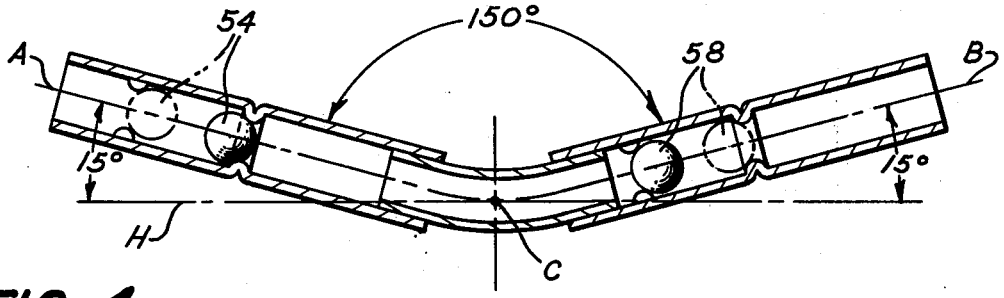
FIG. 4 is a sectional view of the indoor bypass line in a second orientation.

In order to insure operation of the flow control bypass system, as described above, it is necessary that the gravity biased ball valves 54 and 58 operate in the designated manner and accordingly must be arranged at some point above the level of their respective valve seats 56 and 62. To this end, the Axis A and B of portions 50 and 51 respectively are rotated so that their point of intersection C lies in horizontal line H. The angle between the horizontal designated by H and either of the Axis A or B must be at least 15° as illustrated in FIG. 4.

While angles of less than 15° may provide enough incline to maintain the ball valve members in their respective design position, it has been determined that when the minimum angle is 15° relative to the horizontal, the operation of the valve system is always within design limits.

It should be apparent to those skilled in the art that the embodiment described heretofore is considered to be presently preferred form of this invention. In accordance with the Patent Statutes, changes may be made in the disclosed apparatus and the manner in which it is used without actually departing from the true spirit and scope of this invention.

What is claimed is:

1. A split refrigeration system air conditioner of the heat pump type including an outdoor section having an outdoor heat exchanger and an indoor section having an indoor heat exchanger, said indoor and outdoor heat exchanger being connected in a closed refrigerant circuit;

means in said circuit including a compressor having a discharge line and a suction line and reversing valve means for reversibly connecting said discharge and suction line to said heat exchangers for effecting flow of refrigerant through said circuit in either direction whereby said heat pump may be operated on a cooling cycle with the outdoor coil functioning as a condenser and receiving high pressure refrigerant from said compressor or in a heating cycle with the indoor coil functioning as a condenser and receiving high pressure refrigerant from said compressor;

an outdoor refrigerant flow control means arranged in fixed relationship relative to said outdoor heat exchanger, and outdoor conduit means arranged for bypassing refrigerant around said outdoor flow control means when said refrigerant flow is in a direction from said outdoor heat exchanger toward said outdoor flow control means;

an indoor refrigerant flow control means arranged in fixed relationship relating to said indoor heat exchanger, and indoor conduit means arranged by bypassing refrigerant around said indoor flow control means when refrigerant flow is in a direction from said indoor heat exchanger toward said indoor flow control means;

said indoor conduit means having a first and second portion;

said portions having their axis arranged so that a horizontal plane passes through the intersecting point of the two respective axes;

said axes extending from said intersecting point at a predetermined angle from said horizontal plane.

2. The system as recited in claim 1 wherein;

said means arranged for bypassing refrigerant in said indoor conduit bypass means including a gravity biased ball valve in one of said portions being arranged in a normally closed position and second gravity biased ball valve in the other of said portion being arranged in a normally open position so that refrigerant flowing from said indoor heat exchanger will flow through said indoor flow control means and refrigerant flowing from said outdoor heat exchanger will flow through said indoor conduit bypass means.

3. The system, as recited in claim 1, wherein said predetermined angle is at least 15°.

* * * * *